US005887905A

United States Patent [19]

Collins

[11] Patent Number: 5,887,905

[45] Date of Patent: Mar. 30, 1999

[54] LABEL FOR THE CONVERSION OF A PHOTOGRAPH OR A CARD INTO A POSTCARD

[76] Inventor: Amy L. Tsui Collins, 236 Bonita Ave., Piedmont, Calif. 94611

[21] Appl. No.: 298,604

[22] Filed: Aug. 31, 1994

Related U.S. Application Data

[63] Continuation-in-part of Ser. No. 254,188, Jun. 6, 1994, which is a continuation-in-part of Ser. No. 176,796, Jan. 3, 1994, abandoned.

[51] Int. Cl.[6] ..... B42D 15/00

[52] U.S. Cl. ..... 283/81; 283/116

[58] Field of Search ..... 283/81, 116, 56; 229/92.8, 300

[56] References Cited

U.S. PATENT DOCUMENTS

| | | | |
|---|---|---|---|
| 4,272,327 | 6/1981 | Logan | 283/116 |
| 4,278,199 | 7/1981 | Tanaka | 283/116 X |
| 4,947,566 | 8/1990 | Hoebel | 229/92.8 X |
| 4,953,780 | 9/1990 | Ross | 229/92.8 |
| 5,044,669 | 9/1991 | Berry | 229/300 X |
| 5,165,726 | 11/1992 | Talbott | 283/116 X |
| 5,232,248 | 8/1993 | Talbott | 229/300 X |
| 5,316,344 | 5/1994 | Popat et al. | 283/116 X |

*Primary Examiner*—Willmon Fridie, Jr.
*Attorney, Agent, or Firm*—Robins & Associates

[57] ABSTRACT

The present invention relates to a label that can be adhered to a photograph to produce a photocard that can be used as a calendar, a diary, a log, a things-to-do card, a memo or note card, an address record, an activity record, an event record, an inventory record, a gift, and an educational card. Two or more of such photocards can be assembled into a booklet. This invention further relates to a kit that contains the present labels and a binder, a folder, a fastening means, a binding means or a container. This invention also relates to a kit that can be used to produce a booklet, a kit that contains a binding means and a binder connecting means, and a kit that contains a fastening means and fastener connecting means. Methods of producing and using the present labels as well as producing the booklets are provided.

5 Claims, 7 Drawing Sheets

LABEL FOR THE CONVERSION OF A PHOTOGRAPH OR A CARD INTO A POSTCARD

This application is a continuation-in-part of a U.S. patent application, Ser. No. 08/254,188, filed Jun. 6, 1994, which is a continuation-in-part of Ser. No. 08/176,796, filed Jan. 3, 1994, now abandoned the contents of which are hereby incorporated by reference.

BACKGROUND OF THE INVENTION

The present invention relates to a label (hereafter "a photolabel") that can be used for adhesion to and conversion of a photograph or other documents, such as a map, into a postcard (hereafter "a photocard"), or for recycling or reusing a used postcard or the printed or decorated section of a greeting card, and converting it into a new postcard, and methods of doing so, as well as methods of producing and using the photolabels and photocards. The present invention also relates to a photolabel that can be used with a photograph as a greeting card, a thank you note, an invitation, a change of address notice, a calendar, a diary, a log, a things to-do list, an address record, an inventory record, an activity record, an event record, a memo or note card, and an educational card.

Travellers wishing to communicate with friends or relatives often purchase and send picture postcards that are available at the time and place of purchase. Although in most instances, the picture postcards depict beautiful sceneries or objects, they lack a personal touch. Nowadays, when photographs can be developed very quickly, such as in about one hour, it would be advantageous to be able to send as a picture postcard, a photograph of one's choice.

Furthermore, it has become customary to print a photograph that contains a greeting on the same side of the photograph, such as a Christmas greeting. Such a photograph, however, requires separate processing and still has to be sent in an envelope and still requires the postage cost of a regular letter. It would be advantageous to send such or similar greetings without the use of an envelope. It would also be advantageous to be able to send such greetings with only the postage cost of a postcard.

Additionally, when a person moves from one address to another, he or she usually sends a change of address to his or her friends and relatives. Presently, such postcards are typically available from the postal service. It would be desirable, in conjunction with such a notice, to send a picture of the new residence.

Further, in these times of social awareness of the conservation of environmental resources, it would be advantageous to be able to reuse or recycle greeting cards or postcards one or more times before discarding them.

Still further, the currently available postcards is typically divided spatially into two equal portions: a left-hand portion for writing messages and a right-hand portion for placement of address of the addressee ("the address portion"). Typically, a lot of space is wasted in the address portion that can be better utilized.

Yet further, it will be advantages if treasured photographs of people or things can be put to good use, for example, by turning them into items that can be used for general purposes or on a daily basis, such as calendars, address records, logs, diaries, a memo or note card, or a things to-do card. Such records can be a record of people, events, or things, such as a record of an inventory of a business or students or activities in a class.

It will be further advantageous if the such photographs can be made into a booklet or filed in a card file with notations or comments written on the back thereof. It will be additionally advantageous if such photographs or booklets of photographs can be turned into educational materials for children.

SUMMARY OF THE INVENTION

It is, therefore, an object of the present invention to provide a label that can be used to convert a photograph into a postcard. It is also an object of the present invention to provide a label that can be used to recycle old greeting cards and postcards so that the cards and postcards can be reused. It is another object of the present invention to provide a label that can be used for attachment to and for mailing of any material that is desired to be sent in the form of a single sheet, for example, for attachment to a map with directions to attend a function, as an invitation.

It is another object of the present invention to provide a label for a photograph so that it can be sent through the mail without an envelope. It is still another object of the present invention to provide a label for a photograph so that it can be sent with the postage cost of a postcard, currently $0.19, instead of the postage cost of a regular letter, currently $0.29 in the U.S.

It is also an object of the present invention to provide a label for a photograph so that it can be sent as a change of address notice, for example, when the photograph is a picture of a new residence.

It is further an object of the present invention to provide a label for a photograph so that more space is provided for messages than for the address of the addressee as currently being provided in the typical picture postcards being sold, for example, in tourist attractive areas.

It is another object of the present invention to provide a label for a photograph that can be mass produced and suitable for use by many people for different occasions.

It is, moreover, another object of the present invention to provide a label that contains preprinted matter that is suitable for use, after adhesion to a photograph or other document, as a greeting card, a thank you note, an invitation, a calendar, a diary, a log, an address card, a things-to-do record, an activity record, an inventory record, a gift, or an educational card, either singly or a plurality thereof as part of a booklet or kit to be assembled into a booklet.

It is another object of the present invention to provide a kit that comprises one or more of the present photolabels and at least one of a binder, a folder, a fastening means, a binding means, and a container. When provided in a kit format for assembly into a booklet, it is an object of the present invention that the present labels be provided either with or without preprinted matter and that the labels be of any size, larger or smaller than those acceptable for mailing as a postcard.

It is a further object of the present invention to provide a kit that contains a binding means or a fastening means and a plurality of a binder connecting means or a fastener connector means, respectively, that allows adhesion or attachment of a photograph to the binding means.

It is yet a further object of the present invention to provide a photolabel that can be bigger or smaller than that acceptable for mailing to fit any size photographs when the label contains preprinted matter that is appropriate for a calendar, a diary, a log, a things-to-do record, a memo or note card, an address record, an activity record, an event record, an inventory record, a gift, or an educational card.

In accordance with one of the objects of the present invention, therefore, a label is provided that is a sheet member that contains a first surface and a second surface, the first surface contains a gummed or a self-adhesive component while the second surface is suitable for writing thereon, the label being of a size that is acceptable for mailing through the postal service, for example, the U.S. postal service, the sheet member being substantially non-rigid and is other than cardboard, and the second surface contains a preprinted message that is suitable for notification of a change of address, for conveying a greeting or an invitation.

In accordance with a further object of the present invention, the label is of an approximate size that is acceptable for mailing as a postcard. Such a label can be at least about 3 inches by about 5 inches, or about 4 inches by about 6 inches or, for example, about 3½ or 3⅜ or 3¼ inches by about 5 inches or 4⅞ or 4¾ inches, respectively, or alternatively, about 3⅞ or 3¾ inches by about 5⅞ or 5¾ inches, respectively, or larger to fit any size photographs.

In accordance with another object of the present invention, the label is separated into two or more sections or portions by a dividing line, either in the form of a ruled line or one or more lines of writing, including "Patent Pending," "Serial Number," or "Patent Number," or abbreviations thereof, a copyright notice, and/or the name and address of the seller of the label. One such portion is suitable for placement of the name and address of an addressee ("the address portion") and one other portion is suitable for placement of messages, such as greetings, invitations, or change of address ("the message portion"). The dividing line can be drawn such as to separate the label into vertical portions to produce a left-hand portion and a right-hand portion, for example, or horizontal portions to produce a top portion and a bottom portion when the label is used in either the landscape or portrait mode.

In accordance with yet another object of the present invention, the label can be used for attachment, such as by adhesion, to any material that is desired to be sent as a single sheet, for example, a map with directions to attend a function, the composite of which can be used as an invitation. The material to be sent can be a single item or can be a composite made up of several items. As an example, the label of the present invention affixed to a map can be used and sent as an invitation to attend a function. If more than one map is required, the maps can be pieced together to fit the label.

In accordance with a further object of the present invention, the label can be provided with a transparent cover for protection of the photograph or for providing the appropriate size requirement of the photograph for mailing.

In accordance with yet a further object of the present invention, a method for conversion of a card or a photograph into a postcard and a method of reusing a postcard or a greeting card are provided by attaching the label of the present invention onto the back of a photograph or on top of a previously written postcard, or on the back of the decorative portion of a greeting card.

In accordance with yet another object of the present invention, a label is provided that is suitable for conveying a greeting such as a birthday greeting, an anniversary greeting, a get-well greeting, a Valentine greeting, a mother's day greeting, a father's day greeting, a grandparent's day greeting, a boss' day greeting, a secretary's day greeting, a graduation greeting, a congratulatory greeting, a new baby greeting, a Halloween greeting, a Thanksgiving greeting, a Hanukkah greeting, a Christmas greeting, a New Year's greeting, a Happy Holidays greeting, a bon voyage greeting, a thinking-of-you greeting and a thank you note.

In accordance with yet a further object of the present invention, the preprinted message on the label is in color. In accordance with still another object of the present invention, the label contains a drawing or a decoration. In accordance with yet object, at least one portion of the present label is in color.

In accordance with yet another object of the present invention, a label is provided that comprises a sheet member that comprises a first surface and a second surface, the first surface containing a gummed or self-adhesive component that is sufficient to cause adhesion of the label to a photograph, and the second surface is suitable for writing thereon, the sheet member being made of a material that is substantially non-rigid and is other than cardboard, and the second surface contains preprinted matter that is appropriate for a calendar, a diary, a log, a things-to-do card, a lined page, an address record, an activity or event record, an inventory record, a gift, or an educational card.

In accordance with an additional object of the present invention, a kit is provided that contains (a) two or more labels, each label comprising a sheet member that comprises a first surface and a second surface, the first surface containing a gummed or self-adhesive component that is sufficient to cause adhesion of the label to a photograph to produce a photocard, the second surface being suitable for writing thereon, the sheet member is made of a material that is substantially non-rigid, and is other than cardboard, and (b) at least one of a binder, a folder, and a fastening means, and a container. The kit is useful for assembling the photocards into a booklet form.

In accordance with another object of the present invention, a kit is provided that comprises a fastening means and a fastener connecting means or a binding means and a binder connecting means.

In accordance with yet another object of the present invention, there is provided a booklet containing two or more photocards, each photocard comprising a photolabel attached to a photograph or other suitable document to produce a photocard, and the photolabel comprises a sheet member that comprises a first surface and a second surface, the first surface comprising a gummed or self-adhesive component that is sufficient to cause adhesion of the label to the photograph, and the second surface is suitable for writing thereon, the sheet member is made of a material that is substantially non-rigid, and is other than cardboard.

In accordance with a further object of the present invention, there is provided a method of producing a booklet that comprises a plurality of photocards, comprising the steps of: (a) attaching a photolabel to a photograph to produce a photocard, (b) repeating step (a) as desired to produce two or more photocards, and (c) assembling the photocards into a booklet form, the photolabel comprising a sheet member that comprises a first surface and a second surface, the first surface comprising a gummed or self-adhesive component that is sufficient to cause adhesion of the label to the photograph, and the second surface is suitable for writing thereon, the sheet member is made of a material that is substantially non-rigid, and is other than cardboard.

In accordance with a further additional object of the present invention, a method is provided for conversion of a photograph into a calendar, a diary, a log, a journal, an address record, an activity record, an event record, an inventory record, a gift, or an educational card comprising adhering to the photograph a photolabel appropriate for such purposes.

Further objects, features, and advantages of the present invention will become apparent from the following detailed description. It should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE DRAWINGS

FIG. 2A shows that the address portion can be used in a portrait mode while the message portion can be used in a landscape mode. FIG. 2B shows both the address portion and the message portion in a portrait mode.

DETAILED DESCRIPTION OF THE PREFERRED EMBODIMENTS

Figure 1A:
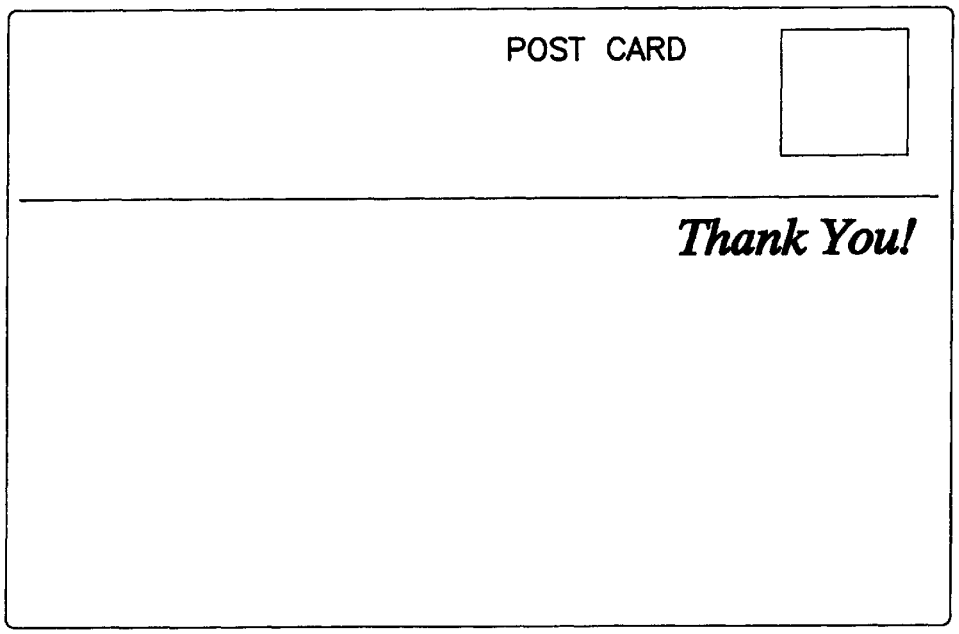
FIG. 1A shows one embodiment of the label of the present invention that can be used in a landscape mode.

It has been discovered that a photolabel can be used to convert a photograph or any suitable document such as a map, into a postcard. In one embodiment of the present invention, the present label contains one or more preprinted messages that are suitable for notification of a change of address or for conveying a greeting, an announcement, an invitation, a thank-you note, or other messages for a given occasion. The present invention can also be used to recycle a postcard or a conventional greeting card by placement of the present label on the backside of such cards. For example, the present label can be placed over the previous written material of a postcard or the back of the decorative portion of a greeting card.

The label of the present invention is suitable to be sent as a greeting or an announcement to someone. For example, the present label can have printed thereon words such as Happy Mother's Day, Happy Father's Day, Happy Grandparent's Day, Happy Birthday, Happy Anniversary, Happy Boss' Day, Happy Secretary's Day, Happy Halloween, Happy Thanksgiving, Happy New Year, Congratulations, Merry Christmas, Happy Holidays, Happy Valentine's Day, Thinking of You, Bon Voyage, Get Well Soon, Thank You, A New Baby, You're Invited. Such a label can be placed on a photograph of, for example, a child, and sent to a parent for Happy Father's Day, Happy Mother's Day or to one or more grandparents for Happy Grandparent's Day. Such a label can also be placed on the back of a photograph of a present or someone opening a present, for example, for a thank you note.

The label of the present invention can also be used for notices, such as a Change of Address notice by placement of the label on the back of a photograph of, for example, a new home.

For the purpose of the present invention, the term "label" is used in the conventional sense, for example, as in Avery® self-adhesive removable labels, Avery® self-adhesive permanent labels, Avery® self-adhesive file folder labels (Avery Label, Azusa, Calif.; Elmhurst, Ill.; Gainesville, Ga.; New Brunswick, N.J.); Eureka® Self-Stick Coding Labels (The Paper Magic Group, Inc.©, Troy, Pa. 16947); and other self-adhesive labels as those being sold by Lancer Label (Omaha, Nebr. 68114) that are currently on the market. Thus, the label can be a permanent label that, once attached to the surface desired, is difficult to remove without damage to the label, or can be a removable one that can be attached to a desired surface and be removed again without damage to the label.

The label of the present invention may be made of any materials conventionally used for such purposes as in the labels mentioned above. The only requirement for the material is that one surface of the material be suitable for writing thereon and the second surface of the material accepts an adhesive such that the adhesive will facilitate the attachment of the label to a photograph. The material of the label, therefore, can be a sheet member such as paper, a suitable synthetic polymer, or a combination thereof, and is other than cardboard. The paper to be used may be plain writing paper, and the like with or without reinforcement. The paper can be white or colored.

The adhesive that is suitable for the present invention can be any adhesive that is currently available in the market. In one preferred embodiment of the present invention, the adhesive is one conventionally used for making self-adhesive or self-stick labels. The adhesive can also be of the type that makes removable labels or permanent labels. The adhesive of the present invention may also be of the type that makes a conventional gummed label containing a glue which, when wet, becomes sticky and will attach to paper, for example, the adhesive used for postage stamps.

The label of the present invention may be ordered from a commercial source such as Avery or Lancer Label (San Diego, Calif. 92122).

The label of the present invention preferably has a line, either a ruled line or a line of writing, dividing the label into at least two portions, one for placement of the name and address of the addressee ("the address portion"), the other for placement of messages, greetings, or other writings ("the message portion"). In one embodiment, the line divides the label into two portions. In a preferred embodiment, the line divides the label into two unequal portions—a smaller address portion and a bigger message portion. In a particularly preferred embodiment, a space is allocated in the upper right hand corner of the address portion for placement of a postage stamp. In another preferred embodiment of the present invention, at least one portion of the label is in a different color.

Figure 1B:
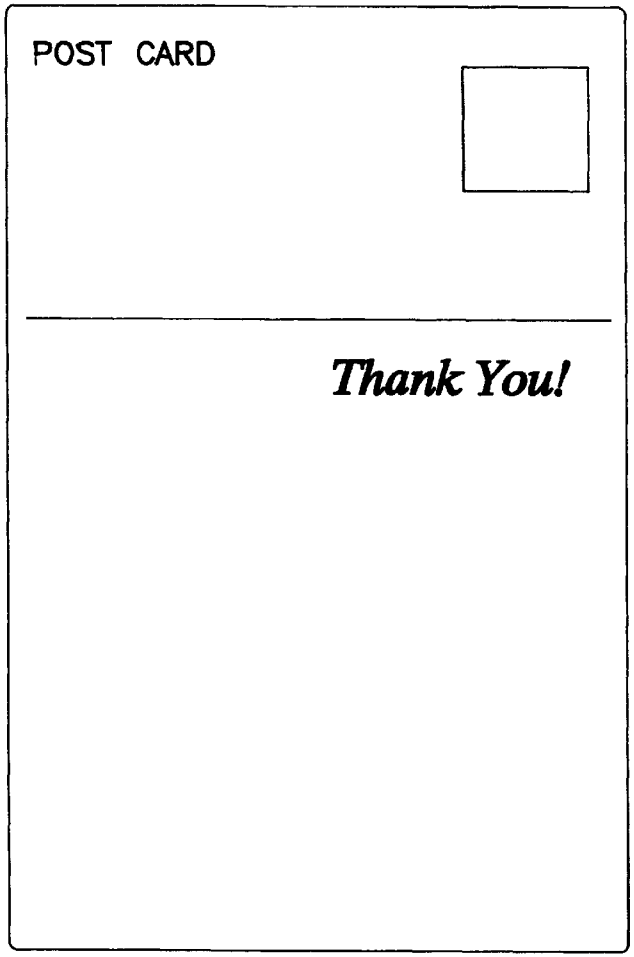
FIG. 1B shows one embodiment that can be used in a portrait mode. In each of these instances, the address portion is at the top and the message portion is at the bottom of the label.
Figure 2A:
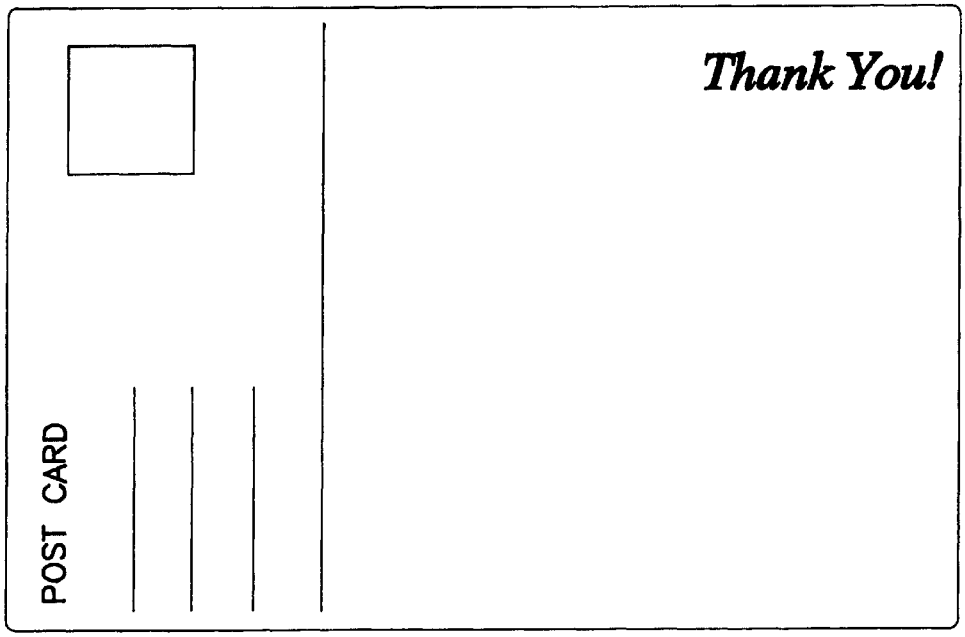
FIGS. 2A and 2B show other embodiments of the label of the present invention that contain lines for placement of address in the address portion of the label.
Figure 2B:
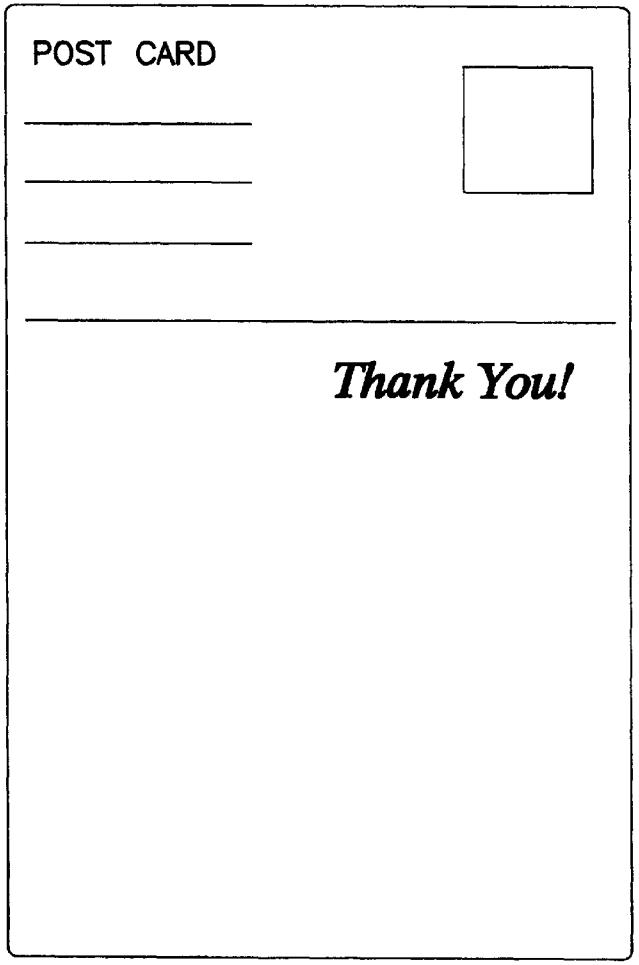
Figure 3A:
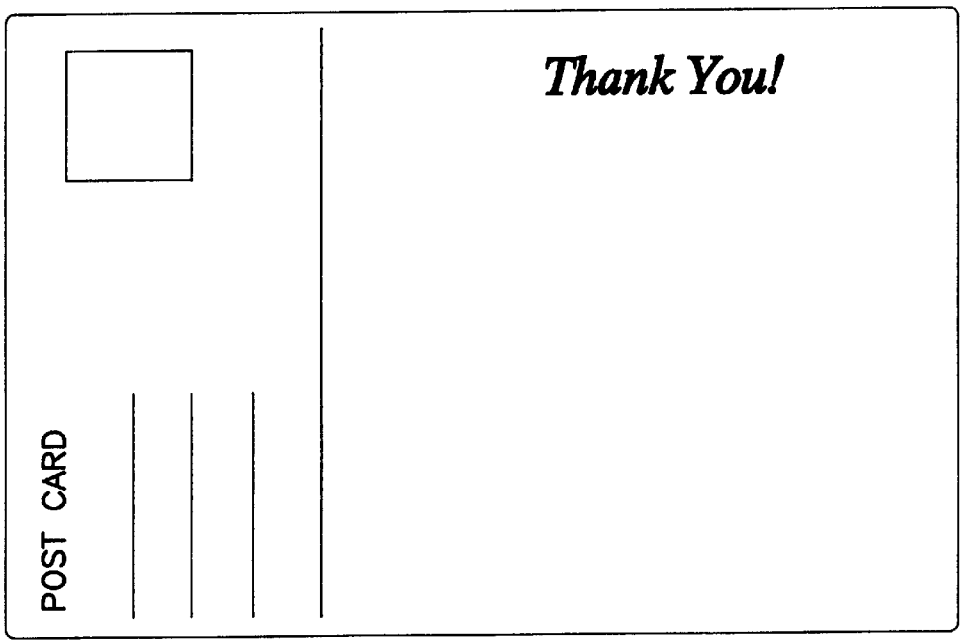
FIGS. 3A and 3B show variation in the placement of the preprinted greeting as contrasted with those in FIGS. 2A and 2B.
Figure 3B:
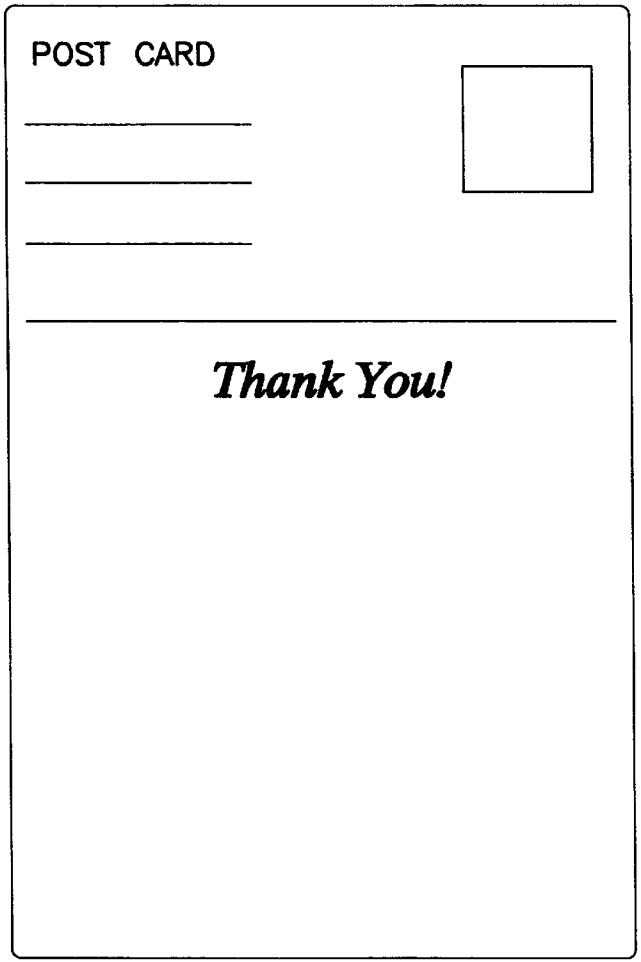

In a preferred embodiment of such invention, the postcard can be read vertically, i.e., in a portrait mode, as shown in FIG. 1B. In another preferred embodiment, the postcard can be read horizontally, i.e., in a landscape mode, as shown in FIG. 1A. In an alternative embodiment, the address portion can be placed in a portrait mode and the message portion can be placed in a landscape mode, as shown in FIG. 2A. In a most preferred embodiment, the address portion is situated at the top portion of the label and the message portion is situated on the bottom portion of the label, as shown in FIGS. 1A and 1B, for example.

The preprinted message can be placed in any suitable location in the message portion, either in a portrait mode or a landscape mode, as shown in FIGS. 1A, 1B, 2A, and 2B, for example.

In a preferred embodiment of the present invention, the label is used in the landscape mode with a top portion allocated for the address portion and the bottom portion allocated for the message portion. In another embodiment of the present invention, the address portion is in a different color from the message portion. In an alternative embodiment of the present invention, the label is provided with a third portion. Such a third portion can be below the message portion and can be used for return address, telephone number or other information to be distinguished from the message portion. In a preferred embodiment, such a third portion can be in a color different from the address portion and the message portion. In one embodiment of the present invention, the label contains a vertical line, either a ruled line or a line of writing, that divides the label into approximately two equal portions, as in a conventional postcard.

The address portion can be blank. Optionally, the address portion can contain the words "POST CARD," or a square or rectangle for placement of a postage stamp. Preferably, lines are provided in the address portion of the label for placement of the name and address of the addressee. In a preferred embodiment of this invention, the address portion contains at least 3 horizontal lines, preferably 4 horizontal lines that are suitable for placement of a name and an address thereon.

In an alternative embodiment, the label of the present invention can contain horizontal lines for placement of the name and address of the addressee as described above in the absence of a line dividing the address portion from the message portion.

In one embodiment of the present invention, the label can be of any size that closely approximates the size of a photograph but is of a minimal size that is acceptable for mailing through the postal service. Indeed, the postal service of most countries places a minimum size requirement for mailing articles through the mail. The label of the present invention meets such a minimum size requirement.

In a preferred embodiment of the invention, the label herein is rectangular, at least about 3 inches long and at least about 5 inches wide ("3×5"), preferably, at least about 3½ inches by 5 inches "3½×5"), more preferably, about 4 inches long and about 6 inches wide ("4×6"), and most preferably, about 3⅞ inches long and about 5⅞ inches wide ("3⅞×5⅞"). The label can further be of a larger size, for example, one suitable for covering the back surface of the currently available panoramic photograph that is longer than the 3×5 or 4×6 photographs, preferably about 3 or 4 inches wide and about 7 inches long, more preferably about 8 inches long, still more preferably, about 9 inches long, and most preferably, about 10 inches long.

In another embodiment of the present invention, for the purpose of mailing photographs that do not meet the minimum size requirement, the label of the present invention is provided with a transparent cover attached to the first surface that contains the glue or adhesive such that the smaller photograph can be placed between the transparent cover and the first surface. In a preferred embodiment, the label herein may be provided with a border that serves to frame the photograph being sent.

The transparent cover may be made of any material that is conventional in the art for such purposes, for example, cellophane paper or plastic. The border that frames the photograph can be made of any material acceptable to the postal service. For example, the border may be made of writing paper, cardboard paper, plastic, wood, etc.

The label of the present invention may be provided with a preprinted name of the sender or with a message or greeting. Such message or greeting includes a birthday greeting, an anniversary greeting, a get-well greeting, a Valentine greeting, a mother's day greeting, a father's day greeting, a grandparent's day greeting, a graduation greeting, a boss' day greeting, a secretary's day greeting, a Halloween greeting, a Thanksgiving greeting, a Hanukkah greeting, a Christmas greeting, a New Year greeting, a Happy Holidays greeting, a bon voyage greeting, a hello greeting, a new baby announcement, a congratulatory note, a "hello" note, a "thinking of you" note, a "wish you were here" note, and a thank you note. For example, see FIG. 1A for a "thank you" note.

The present invention, thus, includes a method of converting a photograph into any of the cards mentioned herein by attaching, such as by adhering, the present photolabel onto an appropriate photograph to produce such a card. For example, therefore, the label of the present invention that contains a preprinted "Thank You" message can be affixed to the back of a photograph of a person opening a present or a photograph of a present and sent as a thank you note.

The preprinted message or messages on the label of the present invention can be black or in color while the label is white or of a contrasting color as compared to the preprinted message. In an alternative embodiment of the present invention, the preprinted message can be in color, and the label can be either white or a color that is different from the color of the preprinted message.

Figure 4B:
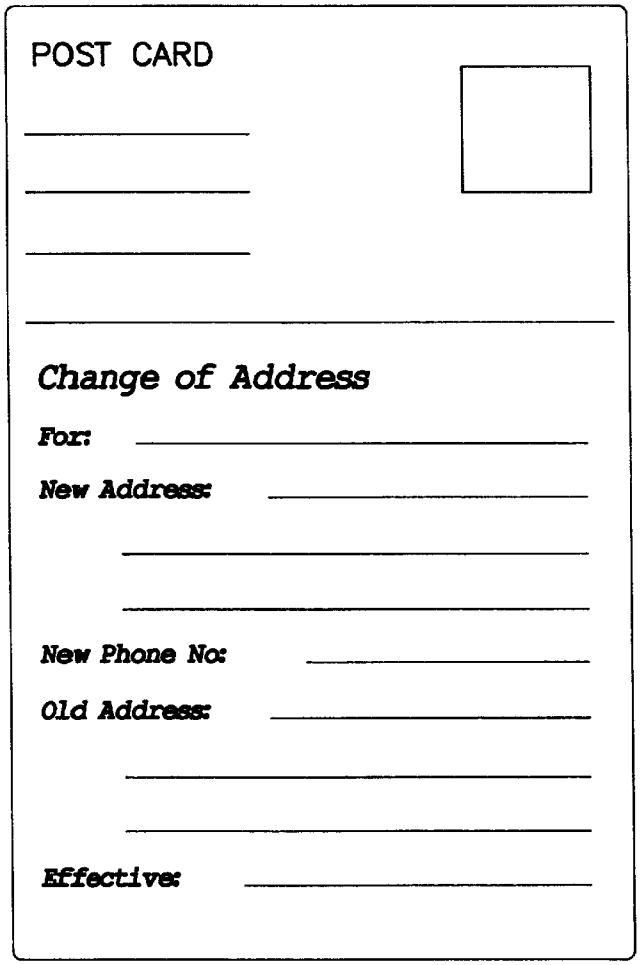
FIG. 4B shows one embodiment of the present invention that is suitable to be used as a change of address.

In another embodiment of the present invention, the label contains writing that is suitable for use for change of address. For example, the label may contain one or more of the terms "New Address," "New Telephone No.," "Effective Date," "Old Address," "Old Telephone No.," and a blank line or a blank space after each of those terms, as shown in FIG. 4B, for example. The present invention, therefore, includes a method of converting a photograph into a change of address notice by adhering a photolabel that contains a preprinted "Change of Address" message onto a photograph of, for example, a new home.

Figure 4A:
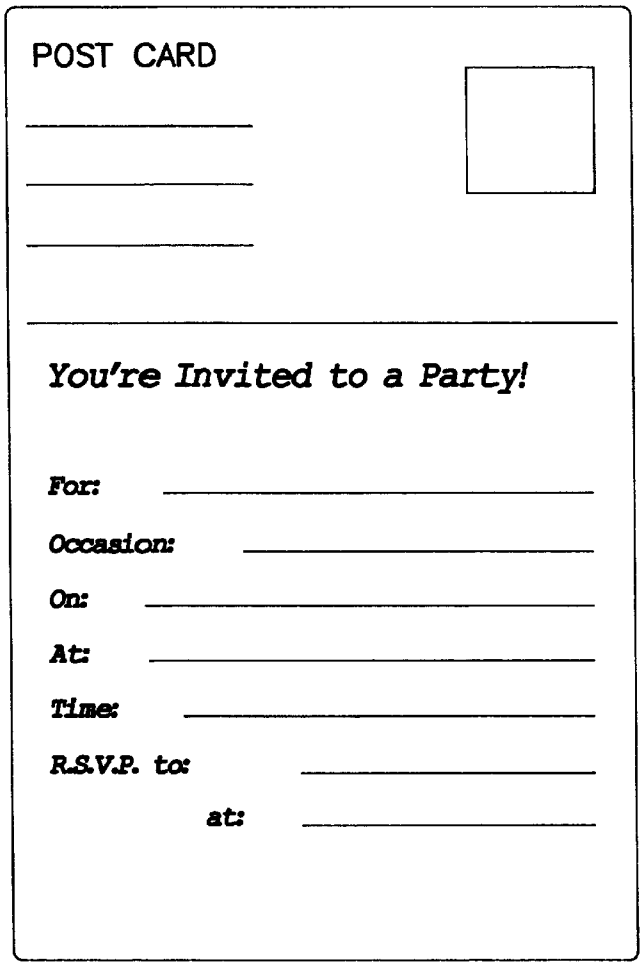
FIG. 4A shows one embodiment of the label of the present invention that is suitable for use as an invitation.

In a further embodiment of the present invention, the label contains writing that is suitable for use as an invitation. For example, such an invitation may contain one or more of the terms "You're Invited," or "An Invitation,"; "For," or "Name"; "Time," or "At"; "On," or "Date"; "Place," or "At"; and "R.S.V.P.," as shown in FIG. 4A, for example. The present invention also includes a method of converting a photograph into an invitation by adhering a photolabel that contains preprinted information as above.

The label of the present invention can contain a drawing or a decorative rim at the outer edges thereof. In a preferred embodiment of the present invention, the label can have drawings or decorations appropriate for the message to be sent. For example, the label can contain a simple drawing of a flower that can be colored by a small child to be sent to a parent or grandparent for, e.g., mother's day or grandparent's day. Drawings and decorations that are suitable in a greeting card can be included in the present label, for example, a diploma and/or a cap and gown can be present in the label for use as a congratulatory message to a graduate, and balloons can be present in the label used as a birthday invitation and the like.

In another preferred embodiment, the label is lightweight such that the total weight of the photograph and the label does not exceed 1 ounce. In an alternative embodiment, the label is made of paper of such a weight that would give the photograph to be attached additional weight and strength to minimize damage to the photograph in transit, for example, the weight equivalent to a conventional picture postcard of about the same size as the photograph.

In another embodiment, the present invention can include a backing or release liner for temporary placement of the adhesive label such that the label may be removed therefrom for placement onto a photograph. Such a backing is about the same size as the label and is made of any material conventional in the art, for example, a paper with a waxy or plastic surface. In a preferred embodiment, such backing may be provided with a cut such that the backing of a portion of the label may be peeled off while the backing for the remainder of the label remains, for facilitation of correct placement of the label onto the photograph.

A photograph can, thus, be converted into a postcard, suitable for mailing without an envelope by attaching the label of the present invention on the back surface of a photograph. Similarly, a used postcard can be reused by placement of the label of the present invention over the written material. A used greeting card can also be reused by cutting out the decorative portion of the greeting card and placing the label of the present invention to the backside thereof.

The label of the present invention can also be used to send other single sheet documents, such as a map. A map of an appropriate size for mailing can be affixed to the label of the present invention and used as an invitation, for example for a meeting or a party.

In another embodiment of the present invention, the photolabel can be made out of a sheet member that comprises a first surface and a second surface, the first surface containing a gummed or self-adhesive component that is sufficient to cause adhesion of the photolabel to a photograph, and the second surface is suitable for writing thereon, the sheet member is made of a material that is substantially non-rigid, such as the type of paper that is normally used for writing, typing, printing, copying, etc., and is other than cardboard, and the second surface contains preprinted matter thereon that is appropriate to be used with a photograph as a calendar card, a diary, a log, a things-to-do card, an address card, an activity record, an event record, an inventory record, a gift, or an educational card. In this embodiment, the photolabel need not necessarily be of a size that is suitable for mailing. It can be of any size that photographs can be made, such as wallet size, passport size, or about 3½ inches by about 5 inches, or about 4 by about 6 inches, preferably, about 3⅜ inches by about 4⅞ inches, or about 3⅞ inches by about 5⅞ inches, or more preferably, about 3¼ inches by 4¾ inches, or about 3¾ inches by about 5¾/ inches.

In a preferred embodiment of the present invention, the preprinted matter is appropriate for a calendar including, for example, a daily calendar, in which only one date is printed on a label, a weekly calendar, in which the dates of an entire week are printed on a label, a monthly calendar, in which the dates of an entire month are printed on a label, a yearly calendar, in which the dates of an entire year are printed on a label, or a combination of the foregoing printed on a label. Moreover, the calendar concerned can be for more than 12 months, such as a 16-month school year calendar, in which the dates from September of one year through the end of December of the following year can be printed on a label. Alternatively, the school year calendar can be a 17-month calendar, in which the dates from August of one year through the December of the following year can be printed on a label. Indeed, any number of months of the year can be printed on the present photolabel and all such variations are contemplated by the present invention.

In another preferred embodiment of the present invention, the photolabel can contain preprinted matter that is appropriate for a diary. Such a diary can provide, for example, an actual day, month, and year printed thereon, and/or the day of the week including Monday, Tuesday, Wednesday, Thursday, Friday, Saturday, and Sunday, or abbreviations thereof printed thereon. Moreover, the combination of any one or more of the day, month, year, and day of the week is within the contemplation of this invention. Further, such a diary card can be provided with lines on which to place the writing.

Indeed, the present photolabel can be provided with one or more ruled lines that are suitable for writing thereon and used for any purposes, for example, as a memo or note card, as a things-to-do card or the like.

In a further preferred embodiment of the present invention, the preprinted matter can be appropriate for a log or a journal, such as a travel log or a summer journal, particularly for children. This log or journal can be provided with preprinted lines and/or the term "Date," for example.

In yet another preferred embodiment of the present invention, the preprinted matter on the photolabel is appropriate for recording one or more addresses. Each address record can contain, for example, at least one of the terms: "Name," "Address," "Telephone," and abbreviations thereof or some such similar terms. Address records of separate parties can be in different colors or in alternating colors. Preferably, several address records can be provided on one label. In the context of the present invention, black and white constitute colors as well.

The present photolabels can also be used as an activity record or an event record. The activity record can be used to memorialize all sorts of activities. For example, student activities such as races, competition, debates, etc., and extracurricular activities, such as fencing, soccer games, etc. The preprinted matter that is appropriate for an activity record can include the term "Activity," or abbreviation thereof, for example. Similarly, an event record can be used to memorialize important events, such as an anniversary, an birthday, a wedding, a graduation ceremony, a retirement or any other parties. Such a photolabel can include appropriate preprinted terms such as "Occasion," "Wedding," "Graduation," "Anniversary," "Birthday," "Retirement," or "Party," for example.

In yet another embodiment of the present invention, the preprinted matter is appropriate for an inventory record of goods and services. Such an inventory record can be adapted for different businesses. For example, a car rental agency, a dress rental agency, an apartment or house rental agency, can take a photograph of each item of the inventory and apply thereon, the present photolabel that contains appropriate preprinted matter such as "Date In," "In," "Date Out," "Out," "Item Number," "Inventory Number," or "Number," or abbreviations thereof.

In a preferred embodiment, a photolabel for an inventory record contains preprinted matter appropriate for the business. For example, for a real estate business, the present photolabel can be used for recording an inventory of houses for rent or for sale. Appropriate preprinted matter includes, for example, "Address," "Location," "For Rent," "For Sale," or abbreviations thereof.

A photolabel with preprinted matter appropriate as a gift is also within the contemplation of the present invention. Examples of appropriate preprinted matter includes, for example, "For My Teacher," "Dear Teacher," "For My Mother," "Dear Mother," "Dear Mom," "For My Father," "Dear Father," "Dear Dad," "For My Grandmother," "Dear Grandma," "For My Grandfather," "Dear Grandpa," "For My Aunt," "Dear Aunt," "For My Uncle," "Dear Uncle," "For My Godmother," "Dear Godmother," "For My Godfather," "Dear Godfather," "A Gift for You," and "A Present for You."

The preprinted matter on the present photolabel in another embodiment, can contain material that is appropriate for an educational card. The term "educational card" encompasses subject matter that is useful for teaching purposes. For example, the preprinted matter can be an alphabet or a set thereof, a number or a set thereof, a sum of numbers that are added together, a difference of numbers that are subtracted, a product of a numbers that are multiplied, a dividend of numbers that are divided, a vocabulary word, a phrase, a sentence such as one showing structure, a proverb, a name of a person, a geographical location, a scientific principle, a mathematical formula or algorithm, or a mathematical problem.

Moreover, the present educational photolabel can contain more than a sentence. It can contain a description of a famous historical person, a historical event, a description of a geographical location, an explanation of a scientific principle, an explanation of a mathematical theory, an explanation of a scientific or mathematical problem and solution, or a story or a composition.

All the photolabels herein can contain a decorative border or a drawing or can be in more than one color. Additionally, the preprinted matter can be in a contrasting color or in black.

In another embodiment of the present invention, a kit is provided that contains a plurality of the present photolabels that can be assembled into a booklet and at least one of: a binder such as a 3-ring binder, a folder such as one with pockets, a fastening means such as a metal fastener, a binding means such as a comb that is conventionally used for spiral binding, and a container for holding them. In addition, such kits can further comprise at least one of: a front cover, a back cover, a fastener connecting means, and a binder connecting means. Such a kit, therefore, is suitable for the production of a booklet containing a plurality of photocards, for example, a diary booklet, a journal booklet, an inventory booklet, a log in a booklet form, a calendar booklet, an address booklet, and an educational booklet. In the context of a kit, the photolabels can even be blank photolabels or photolabels with no preprinted writing.

Such a booklet can be made by attaching one photolabel to a photograph to make a photocard, assembling a plurality of the photocards, and inserting them into a folder, or punching holes in the photocards and inserting them into a binder, such as a 3-ringed binder conventionally sold in office supply stores. Alternatively, the photocards can be fastened together by a fastening means to create a booklet. Such fastening means include any fastening devices that are commercially available and that can hold the plurality of photocards together. These fasteners include, for example, the Acco self adhesive fasteners, Acco two piece fasteners, and the Acco round head fasteners being sold by OfficeMax (Shaker Heights, Ohio).

In a preferred embodiment, a binding means can be used in place of a fastening means. The binding means can be any material conventionally used for binding documents into a book or booklet form. It can comprise, for example, a binding comb such as ones used for spiral binding. The binding comb is applied by use of a binding machine such as the Ibico binding system sold by office supply companies, such as OfficeMax. When such a binding machine is used, the photocards are assembled together, holes are punched therein, and a binding comb is inserted into these holes using the machine. A photocard booklet can thus be made.

When such photocards are bound together or fastened together, a front cover and/or a back cover may be added to the set for better protection of the photocards. The front cover and the back cover may be made of the same or different materials. Appropriate cover materials are conventional in the art. For example, they can be plastic and either transparent, translucent or opaque, or cardboard, or reinforced paper.

When the photolabels in the present invention are used for making a booklet, neither the photolabels nor the photographs to be attached thereto need to be of any particular size. They can be of any of the sizes previously mentioned or larger or smaller. The smaller photolabels can be about wallet size or passport size. In a preferred embodiment, these photolabels are approximately ⅛ or ¼ inches shorter than the length or width of the photographs.

Figure 5A:
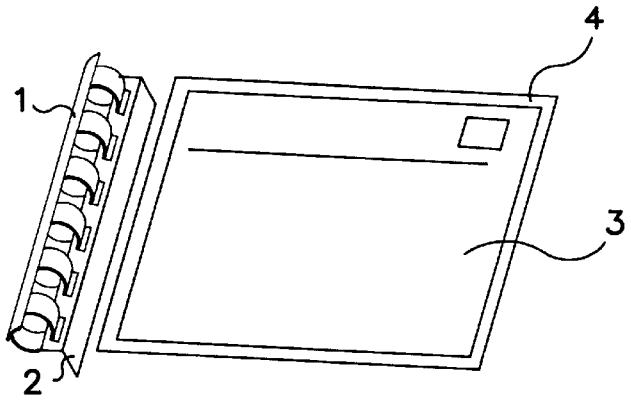
FIG. 5A shows one binding means 1 inserted into one binder connecting means 2 for attachment to a photocard containing a photolabel 3 attached to a photograph 4.

Instead of punching holes directly in the photographs and photolabels for binding them into booklets, in an alternative embodiment, a binder connecting means can be used herein for adhering or attachment to a photocard and for connection with a binding comb. In particular, as shown in FIG. 5A, a binder connecting means 2 will have holes punched in it so that a binding comb 1 can be inserted. The binder connecting means additionally contains an adhesive or gummed component that can adhere to the front and back of a photocard consisting of a photograph 4 and a photolabel 3. The binder connecting means can preferably be made of a material stronger than writing paper and is non-rigid. For example, such material can be plastic or a material similar to the material used for reinforcing punched holes, like the Avery reinforcements being sold by an office supply store such as OfficeMax.

Figure 5B:
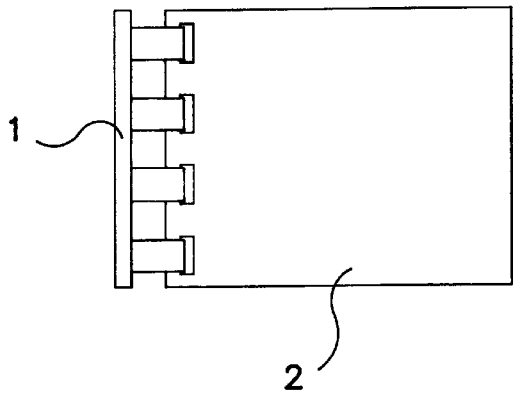
FIG. 5B shows one binding means inserted into a different binder connecting means.
Figure 6A:
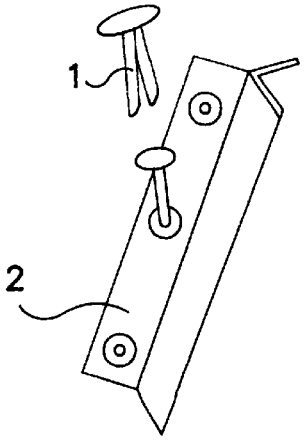
FIG. 6A shows one fastening means 1 inserted into one fastener connecting means 2 for attachment to a photocard.
Figure 6B:
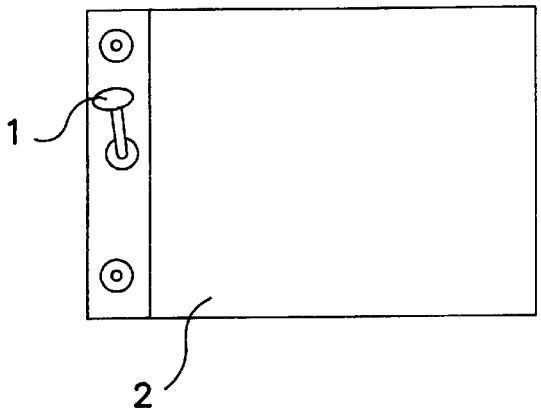
FIG. 6B shows one fastening means inserted into a different fastener connecting means.
Figure 7:
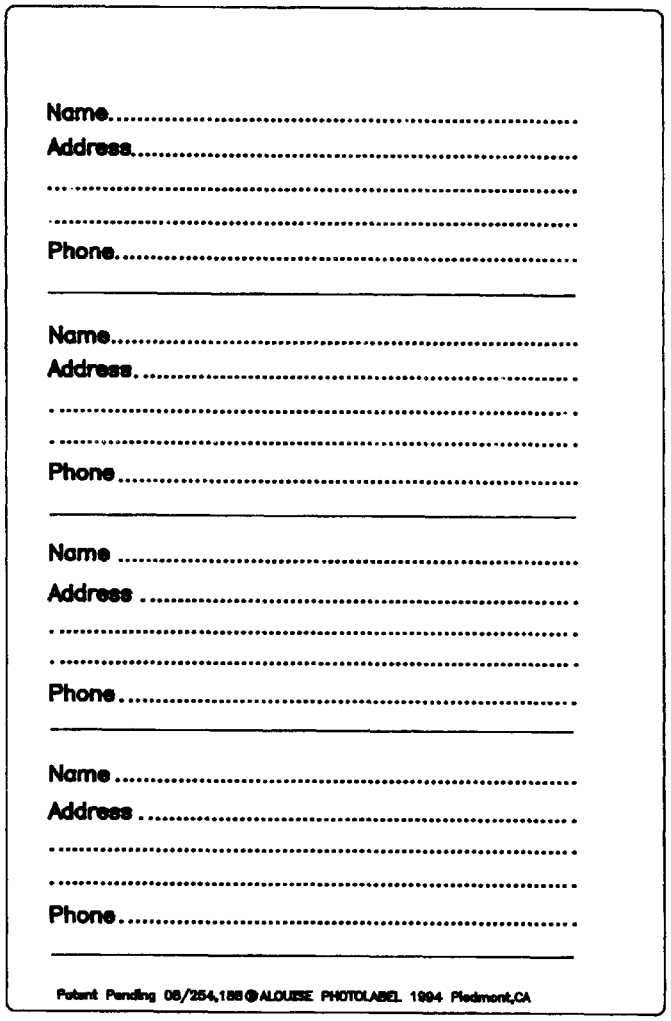
FIG. 7 shows the present photolabel as an address record.
Figure 8:
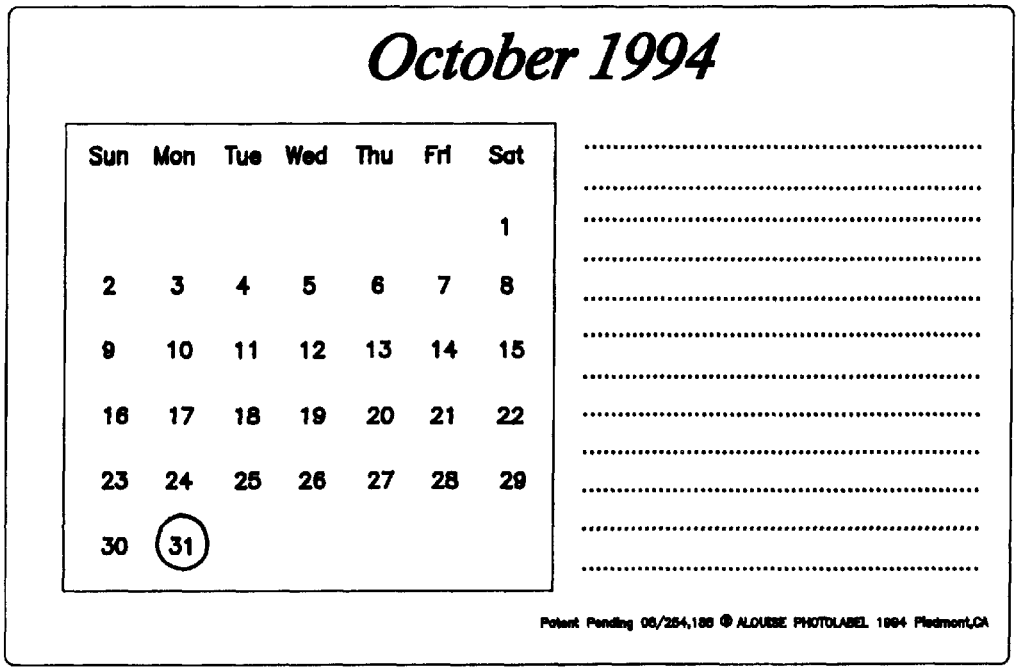
FIG. 8 shows the present photolabel as a one-month calendar.
Figure 9:
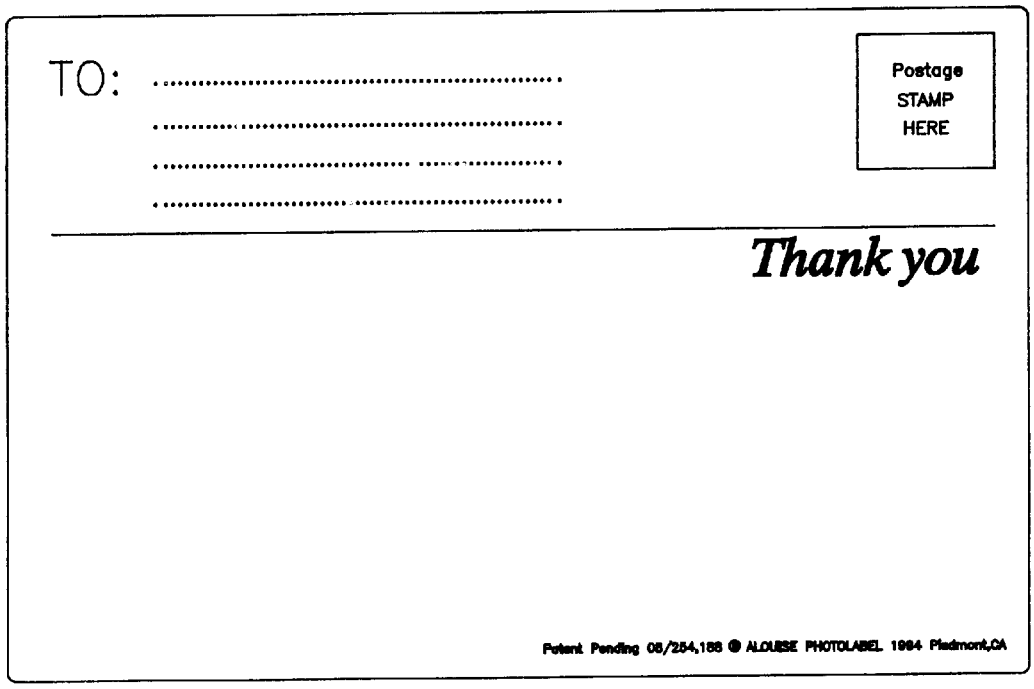
FIG. 9 shows the present photolabel that can be used as a Thank You note.

In an alternative embodiment, the binder connecting means as shown in FIG. 5B and the fastener connecting means as shown in FIG. 6B is a transparent plastic pocket that into which a photocard can be placed. The binder connecting means and the fastener connecting means can have holes already punched therein and can be already bound, for example, by spiral binding or fastened, such as by a fastening means.

Similarly, FIG. 6A and FIG. 6B show alternative fastening means and fastener connecting means.

The kit of the present invention can be held in a container such as a bag or a box. The bag can be made of paper or plastic and can be transparent or translucent or opaque. The box can be a cardboard box, a metal box, a wood box or a plastic box. Both the bag and the box can be plain or decorated with designs or drawings thereon.

To assemble the present booklet as a 12 month calendar booklet, for example, a photolabel for each month of the year can be attached to a separate photograph to form photocards, the photocards can be arranged in order of the months of the year, and a front cover and a back cover can be added to the set of photocards. In a preferred embodiment, holes are punched in the entire set using a binding machine, and a spiral comb is inserted into the punched holes using the binding machine.

In the same manner, in another preferred embodiment, an alphabet booklet can be made by attaching a separate photolabel containing an alphabet preprinted thereon onto a separate photograph, and the set is spiral bound with or without a front cover or a back cover.

Any photocards described herein can be assembled in this manner. Thus, a booklet of numbers, a dictionary booklet, a booklet of new words, a booklet of multiplication tables, a booklet of addition facts, a booklet of subtraction facts, a booklet of proverbs, a booklet of poems, a booklet of scientific principles, a booklet of famous sayings, a booklet of geography facts, of history facts, of scientific and mathematical problems and solutions, a booklet of family history or family tree, etc. can be easily made.

The photolabels herein, in addition to not having any particular size requirements when assembled and sold as part of a kit, further need not contain any preprinted matter and can be completely blank, or can contain simply a drawing or a decoration. Moreover, in another embodiment of the present invention, a kit can contain just a binder comb and a plurality of binder connecting means without any photolabels.

The following examples are given by way of illustration to facilitate a better understanding of the invention and are not intended to limit the invention.

EXAMPLES

The examples presented below are provided as a further guide to the practitioner of ordinary skill in the art, and are not to be construed as limiting the invention in any way.

Example 1

A 3×5 PhotoCard Label

A self-adhesive label with its backing is cut into a rectangle 3 inches wide by 5 inches long. On the surface that is suitable for placement of writing thereon, a vertical line is drawn in the middle of the length of the label dividing the label into a left hand portion and a right hand portion, about 2½ inches wide for each portion. Three horizontal lines, equally spaced, are drawn in the right hand portion of the label, about one inch from the upper edge and about half-an-inch from the bottom edge of the label. The label is ready to be used as for placement onto the back of a photograph as a photocard.

Example 2

A 3×5 PhotoCard Label with a Postage Corner

The above 3×5 PhotoCard can be used as starting material. A square frame, about ½ inch by ½, is drawn on the label, about ¼ inches down from the upper right edge and about ¼ inches to the left of the right hand edge of the photocard label when the label is positioned with the vertical dividing line down and the horizontal lines across the label.

Example 3

A 4×6 PhotoCard Label

A photocard label is prepared as in Examples 1–2 above except that a label that is 4 inches in width and 6 inches In length is used, and the lines are drawn and placed as above, but proportional in size to adapt to this larger label.

Example 4

An Invitational PhotoCard Label

A label is prepared as in one of the Examples 1–3 above. In addition, one or more of the terms, "An Invitation to a Party," or "An Invitation" or "You're Invited," is placed on the left hand portion of the label, along the top thereof, followed by lines containing one or more of the terms (1) "For"; (2) "On" or "Date"; (3) "At" or "Time"; (4) "At" or "Place," along the left hand margin of the label, about evenly spaced down the vertical 3-inch or 4-inch width of the label, with one or more blank spaces or lines after each term for insertion of written materials.

Example 5

A Change of Address PhotoCard Label

A label is prepared as in Examples 1–3 above. In addition, one or more of the terms "New Address"; "New Telephone No."; "Effective Date"; "Old Address"; and "Old Telephone No." are evenly placed thereon down the left hand margin of the label, leaving one or more blank lines or spaces after each term for insertion of written materials.

Example 6

A Greeting PhotoCard Label

A label is prepared as in Examples 1–3 above. In addition, a greeting is placed across the top edge of the left hand portion of the label. The greeting is one or more selected from the group consisting of "Happy Birthday," "Happy Anniversary," "Happy Valentine's Day," "Happy Mother's Day," "Happy Father's Day," "Happy Grandparent's Day," "Happy Secretary Day," "Happy Boss' Day," "Congratulations," "Congratulations on Your Graduation," "Happy Halloween," "Happy Thanksgiving," "Merry Christmas," "Happy New Year," "Happy Holidays," "Peace on Earth," "Thinking of You," "Happy Hanukkah," "Bon Voyage," "Get Well Soon," "Thank You," and "Thank you for your present." Alternatively, the greeting may be placed anywhere on the label.

What is claimed:

1. A label for conversion of a photograph into a postcard comprising a sheet member that comprises a first surface and a second surface, wherein the first surface comprises a gummed or self-adhesive component that is sufficient to cause adhesion of the label to a photograph, and the second surface is suitable for writing thereon, the sheet member is made of a material that is substantially non-rigid, and is other than cardboard, and the second surface comprises a drawing or a decorative border and contains preprinted matter that is appropriate for one selected from the group consisting of: a calendar, a diary, a log, an address record, an activity record, an event record, an inventory record, a gift, a things-to-do card, and an educational card, wherein the second surface further comprising on the second surface a drawing or a decorative border.

2. A kit for providing, and then containing a plurality of photocards, comprising:

a plurality of labels, each of said labels comprising a sheet member having a first surface and a second surface, wherein the sheet member comprises a substantially non-rigid material, and further wherein the first surface of the sheet member comprises a gummed or self-adhesive component sufficient to cause adhesion of the label to a photograph to provide a photocard, and the second surface is suitable for writing thereon; and at least one containing means capable of containing two or more of said photocards, said containing means selected from the group consisting of a binder, a folder, a fastening means, a binding means, and a container.

3. A kit for assembling a photocard booklet from two or more photocards, wherein each of said photocards comprises a label for conversion of a photograph into a postcard, said label comprising a sheet member that comprises a first surface and a second surface, wherein the first surface comprises a gummed or self-adhesive component that is sufficient to cause adhesion of the label to a photograph, and the second surface is suitable for writing thereon, the sheet member is made of a material that is substantially non-rigid, and is other than cardboard, and the second surface contains preprinted matter that is appropriate for one selected from the group consisting of: a calendar, a diary, a log, an address record, an activity record, an event record, an inventory record, a gift, a things-to-do card, and an educational card, wherein the label is attached to a photograph, said kit comprising:

binding means; and a plurality of binding connecting means, each of said binding connecting means comprising a first portion for attachment thereof to a photocard and a second portion capable of cooperating with the binding means to provide an assembled photocard booklet.

4. A kit for assembling a photocard booklet from two or more photocards wherein each of said photocards comprises a label for conversion of a photograph into a postcard, said label comprising a sheet member that comprises a first surface and a second surface, wherein the first surface comprises a gummed or self-adhesive component that is sufficient to cause adhesion of the label to a photograph, and the second surface is suitable for writing thereon, the sheet member is made of a material that is substantially non-rigid, and is other than cardboard, and the second surface contains preprinted matter that is appropriate for one selected from the group consisting of: a calendar, a diary, a log, an address record, an activity record, an event record, an inventory record, a gift, a things-to-do card, and an educational card, wherein the label is attached to a photograph, said kit comprising:

fastening means; and a plurality of fastening connecting means, each of said fastening connecting means comprising a first portion for attachment thereof to a photocard and a second portion capable of cooperating with the fastening means to provide an assembled photocard booklet.

5. A booklet containing a plurality of photocards prepared by attaching a photolabel to a photograph, wherein said photolabel comprises a sheet member formed from a substantially non-rigid material that is other than cardboard, said sheet member having a first surface and a second surface, wherein the first surface of the sheet member comprises a gummed or self-adhesive component sufficient to cause adhesion of the label to a photograph to provide a photocard and the second surface of the sheet member is suitable for writing thereon.

* * * * *